US006299569B1

(12) United States Patent
Rich

(10) Patent No.: US 6,299,569 B1
(45) Date of Patent: Oct. 9, 2001

(54) EXERCISERS AND EXERCISE METHODS

(75) Inventor: Christine A. Rich, Champaign, IL (US)

(73) Assignee: Retrograce Systems Inc., Champaign, IL (US)

( * ) Notice: Subject to any disclaimer, the term of this patent is extended or adjusted under 35 U.S.C. 154(b) by 0 days.

(21) Appl. No.: 08/116,355

(22) Filed: Sep. 2, 1993

Related U.S. Application Data

(63) Continuation-in-part of application No. 07/997,553, filed on Dec. 28, 1992, now abandoned.

(51) Int. Cl.[7] ..... A63B 21/00
(52) U.S. Cl. ..... 482/123; 482/121; 482/134
(58) Field of Search ..... 482/144, 129, 482/130, 121–128, 134, 143

(56) References Cited

U.S. PATENT DOCUMENTS

| | | | | |
|---|---|---|---|---|
| 735,065 | * | 8/1903 | Chellis et al. | 482/129 |
| 743,204 | | 11/1903 | Terry . | |
| 1,019,861 | | 3/1912 | Titus . | |
| 1,691,092 | | 11/1928 | Titus . | |
| 1,698,831 | | 1/1929 | Titus . | |
| 1,904,039 | | 4/1933 | Bruder . | |
| 1,950,174 | | 3/1934 | Harrison . | |
| 2,224,103 | * | 12/1940 | Nilson | 482/122 |
| 3,677,543 | * | 7/1972 | Richardson | 482/129 |
| 3,967,333 | | 7/1976 | Boyd . | |
| 4,198,044 | * | 4/1980 | Holappa | 482/130 |
| 4,304,401 | * | 12/1981 | Goodman | 482/123 |
| 4,325,548 | * | 4/1982 | Piccini | 482/129 |
| 4,403,773 | * | 9/1983 | Swann | 482/130 |
| 4,468,026 | * | 8/1984 | Roark | 482/124 |
| 4,478,413 | | 10/1984 | Siwula . | |
| 4,492,376 | | 1/1985 | Schatz et al. . | |
| 4,909,505 | * | 3/1990 | Tee | 482/129 |
| 5,007,632 | | 4/1991 | Wilkinson . | |
| 5,050,874 | * | 9/1991 | Fitch | 482/130 |
| 5,112,287 | | 5/1992 | Brewer . | |
| 5,178,596 | | 1/1993 | McIntire . | |
| 5,186,098 | * | 2/1993 | Musor et al. | 482/121 |
| 5,197,934 | | 3/1993 | Wirtz . | |
| 5,205,803 | | 4/1993 | Zemitis . | |
| 5,207,626 | | 5/1993 | Einhorn et al. . | |
| 5,336,151 | * | 8/1994 | Van Ballegooie | 482/134 |

FOREIGN PATENT DOCUMENTS

| | | | | |
|---|---|---|---|---|
| 0015797 | * | 8/1893 | (GB) | 482/129 |

* cited by examiner

*Primary Examiner*—Jerome W. Donnelly
(74) *Attorney, Agent, or Firm*—Cook, Alex, McFarron, Manzo, Cummings & Mehler, Ltd.

(57) ABSTRACT

Exercisers are disclosed which include a flexible stretchable loop which is configured to receive both a hand or foot of the person exercising, and which is covered with a stretchable textile which is stretchable therewith. The stretchable loop closely conforms to and grips either the hand or foot of the person when the person is exercising, and is attached to extension spring which has a spring force which permits it to be stretched by the muscle force of a person when the hand or foot of the person is received in the loop so as to extend to a length which exceeds at least 100% of its length at rest, and preferably 200–300% of its length at rest. A variety of exercise routines are made possible by the exercisers of the invention and are disclosed for exercising the thigh, hip joint, groin, arms, stomach, back and/or gluteal muscles.

28 Claims, 6 Drawing Sheets

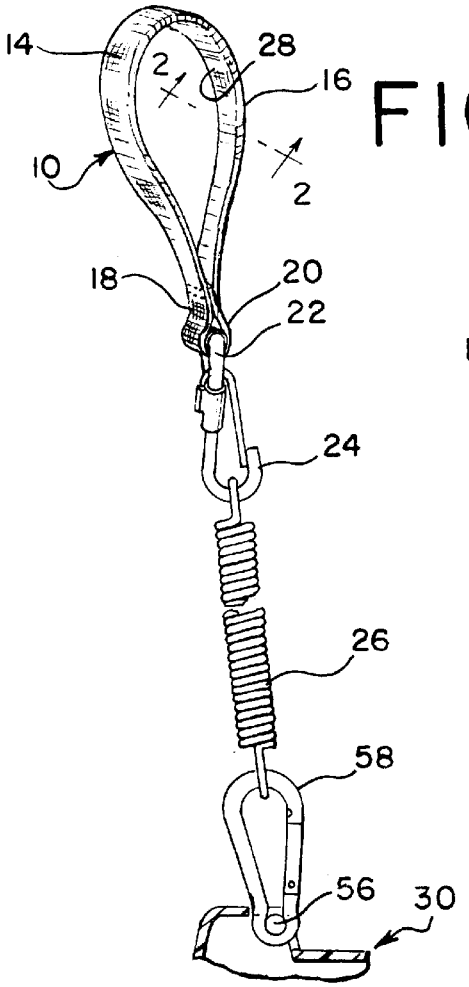
FIG.1
FIG.2
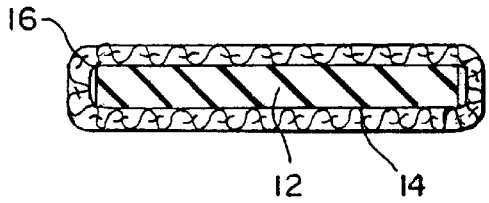
FIG.3
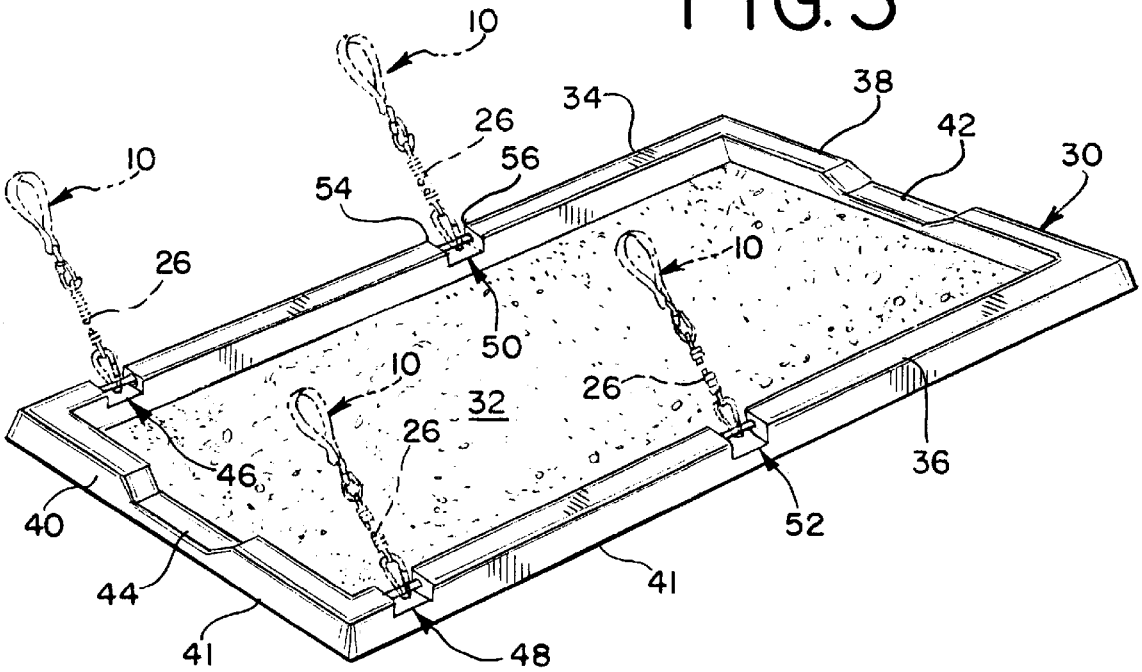

FIG. 4E
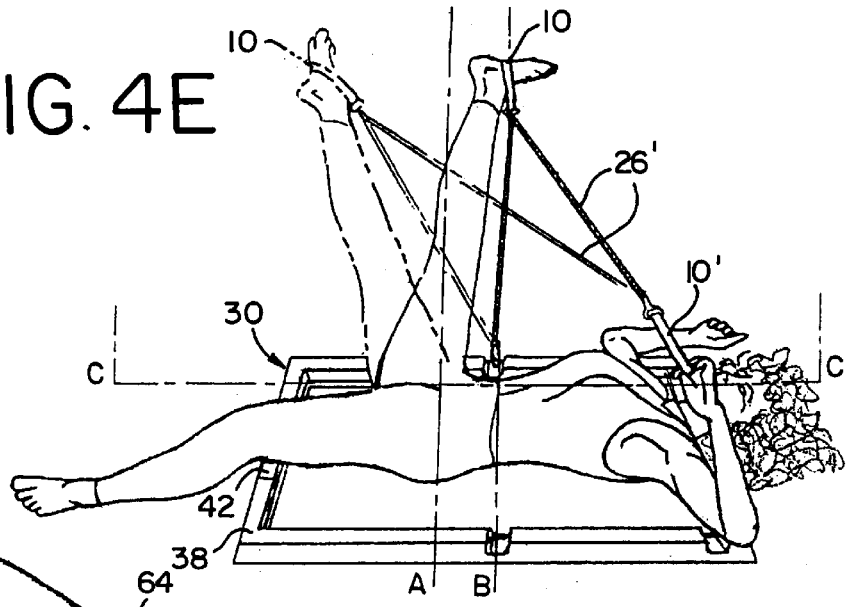
FIG. 4F
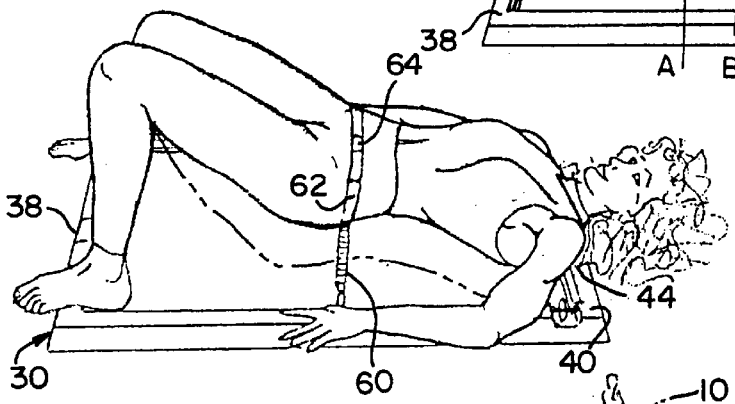
FIG. 4H
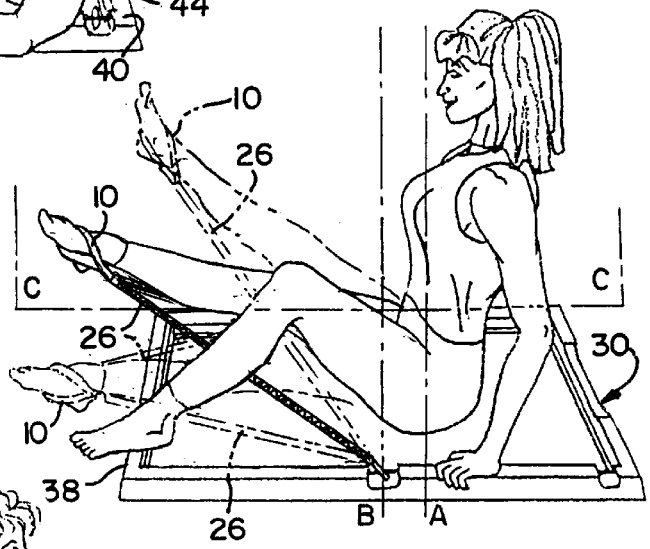
FIG. 4G
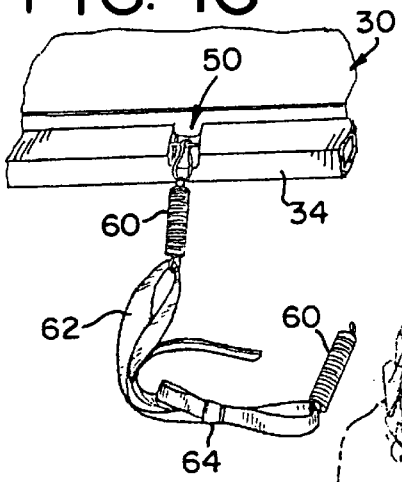
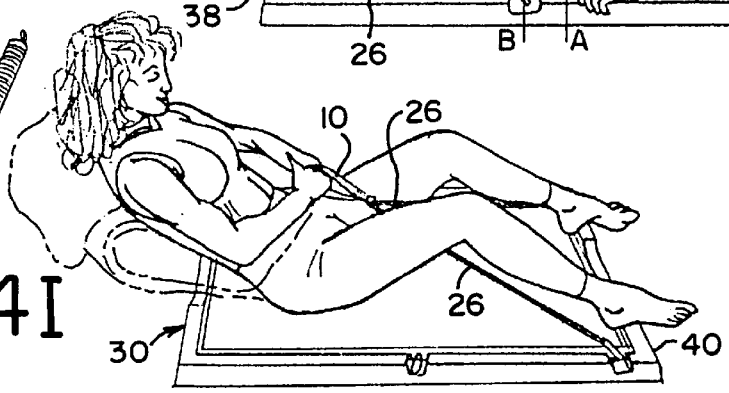
FIG. 4I

EXERCISERS AND EXERCISE METHODS

RELATED APPLICATION

This application is a continuation-in-part of my copending application Ser. No. 07/997,553, filed Dec. 28, 1992 now abandoned.

BACKGROUND OF THE INVENTION

The present invention is directed exercisers, and more particularly to exercisers which may be used in the performance of a wide variety of exercise routines for exercising a number of different muscles or muscle groups in the human body.

Numerous exerciser devices, assemblies and routines are known for use in the exercise and development of various muscles or muscle groups of the human body. However, these various exercisers and exercising routines of which they are capable of performing suffer a number of limitations and disadvantages.

One disadvantage which is common to many of the previously known exercisers is that they are useful in only one or at best a few exercise routines, and they are capable of exercising and developing only a limited number of muscles or muscle groups. For example, chest expanders which comprise one or more springs with hand grips at each end have only typically been used for one exercise and to develop only one group of muscles, the chest and arm muscles. These chest expanders are incapable of use in most other exercises, either due to the fact that the hand grips are not configured to be comfortably and securely received by other parts of the body or, due to their specific purpose and design, the springs are only capable of limited elongation to function for the purpose for which they were designed, i.e. to exercise the chest and arm muscles.

Other forms of exercisers have also been known which have resilient stretchable elements or springs and some form of grip at one end which is configured only to receive the hand or hands of the person exercising and not the feet of that person. As a result, even though such exercisers may be capable of use in several different exercise routines, the routines are generally limited both in the number of exercises which may be performed, as well as the muscles or muscle groups which may be exercised.

A few exercisers have been known which employ some form of flexible loop member or members for receiving or engaging either the hand and/or the foot of the person exercising, and which are attachable to a spring or other resilient stretchable element for performing several exercise routines. However, these flexible loops usually include handles of some sort, which may or may not be cushioned, but in which the loop will not readily and comfortably conform to or grip the hand or foot of the user. Moreover, even though these loops may be generally flexible, they are not stretchable during the exercise routine to grip and better conform to the hand or foot of the user. Also some of these exercisers attach to the user's ankle or knee, rather than to the arch of the foot. This is disadvantageous because the ankle and knee are some of the structurally weakest parts of the body, whereas the arch of the foot is one of the strongest. Thus, the likelihood of injury in these ankle or knee connecting exercisers is substantially increased.

Finally, a few exercisers are known which do utilize flexible endless loops which are also stretchable. However, some of these loops are the only resistance element of the exerciser without any additional springs or other resilient stretchable elements. This results in a substantial reduction of the number of exercise routines that may be accomplished, as well as the number of muscles or muscle groups that may be exercised. Even where such exercisers include a resilient stretchable element attached to the loop, the loop is not capable of receiving the foot of the user, is uncomfortable and difficult to grip in use, and may become slippery from perspiration.

SUMMARY OF THE INVENTION

In the exercisers of the present invention, most if not all of the disadvantages and limitations of the prior exercisers are avoided. In the exercisers of the present invention a wide variety of exercise routines may be accomplished which are not believed to have been previously possible, and which are specifically directed to and isolate each of virtually all of the important muscles or muscle groups of the body without exercising other muscles which should not be or are not desired to be exercised. The exercisers of the invention permit the exercise of desired muscles and muscle groups while avoiding undesirable and possibly dangerous forces on parts of the body, for example the neck, ankles or knees.

Another advantage of the exercisers of the present invention is that a wide variety of exercise routines may be performed without substantially altering the exerciser when one routine is finished and the next routine is desired, for example by adding additional springs and the like. Even where some alteration is needed when changing from one routine to another, the alteration may be accomplished simply and quickly.

Still another advantage of the exercisers of the present invention is that both the hands and the feet may be accommodated, and the portion of the exercisers which receives the hands and/or feet is both flexible and stretchable which permits it to closely conform and firmly grip the user's hand and/or foot. This not only improves its comfort during the exercise routine, but also reduces the possibility of it slipping off of the user's hand and/or foot.

Still another advantage of the exercisers of the present invention is that exercise routines are possible which are not believed to have previously been performed, and which isolate and exercise specific muscles and muscle groups which were not previously capable of exercise, or if they were, either assistance from another person was required or the specific muscle groups could not be isolated without imparting strain to or involvement of other muscles not desired to be exercised. Some of these routines include stretching and resistance to the inner thigh adductor muscles, synergistic exercises of the quadricep and hamstring muscles and/or the outer thigh abductor and inner thigh adductor muscles, and the unassisted stretching of the hamstring and quadricep muscles, the thigh abductor and adductor muscles and/or hip joints. Moreover, the exercisers of the present invention permit a number of exercise routines specifically directed to the gluteus maximus. Heretofore, exercise of some or all of these muscles or muscle groups was difficult and, if possible, required the assistance of a second person during the exercise routine, or undesirable strain to other muscle groups.

Still another advantage of the exercisers of the present invention is that they are compact and lightweight and, therefore, may be easily transported or stored.

In one principal aspect of the present invention, a flexible stretchable loop for an exerciser comprises an elongate flexible elastic stretchable member which is folded back upon itself and joined to form the loop. The loop includes a first portion thereof which is configured for attachment to a resilient stretchable element, and a second portion thereof which is spaced from the first portion and which is configured to receive both a hand or a foot of the person exercising. A stretchable textile covers at least the second portion and is stretchable with the stretchable member, whereby the second portion of the flexible stretchable loop closely conforms to and grips either the hand or foot of the person which is received therein when the person is exercising.

In another principal aspect of the present invention, the loop is rectangular in cross-section at least at the second portion so that it is wider than it is thick at the second portion both in its relaxed and stretched conditions.

In still another principal aspect of the present invention, the flexible elastic stretchable member is formed of an elastomeric material.

In still another principal aspect of the present invention, the first portion of the loop which is configured for attachment to the resilient stretchable element is substantially smaller than the remainder of the loop, and the smaller loop is adapted to be attached to the resilient stretchable element.

In still another principal aspect of the present invention, an exerciser includes a resilient stretchable element which extends and elongates when it is stretched, and a flexible loop attached to at least a first portion of the resilient stretchable element, and which is configured to receive both a hand or a foot of the person exercising. Fastener means is located at a second portion of the resilient stretchable element for fastening the stretchable element either to a stationary anchor or to another flexible loop, and the fastener means is spaced from the first portion of the loop. The resilient stretchable element has a spring force which permits it to be stretched by the muscle force of a person using the exerciser when the hand or foot of the person is received in the loop so as to extend to a length which exceeds at least 100% of its length at rest, and preferably to 200–300% of its length at rest.

In still another principal aspect of the present invention, the exerciser includes a pair of loops one at each end of the resilient stretchable element.

In still another principal aspect of the present invention, either one or both loops are stretchable.

In still another principal aspect of the present invention, the resilient stretchable element is releasably attached to a loop at one end and another loop or stationary anchor at the other end.

In still another principal aspect of the present invention, the exerciser includes a rigid flat platform which accommodates the body thereon of the person exercising, a stationary anchor on the platform, and the fastener means fastens the second portion of the resilient stretchable element to the stationary anchor.

In still another principal aspect of the present invention, a method of exercising the leg muscles of a person includes stationarily fixing an end of a resilient stretchable element to a point which is in a plane which is substantially parallel to a plane which passes through the hips of the person exercising, attaching the opposite end of the resilient stretchable element to the foot of the leg to be exercised, and extending the leg to which the resilient stretchable element is attached to substantially full length to stretch and elongate the element. The extended leg is then swung together with the extended element from a first position in which the leg is closely adjacent a plane bisecting the head and hips of the person exercising to a second position outwardly and away from the last mentioned plane.

In another principal aspect of the present invention, in the last mentioned method, the person exercising is lying on the person's back with the person's leg having the resilient stretchable element attached thereto extended upwardly in the vertical in the first position, and the extended leg is arcuately swung outwardly and away from the vertical to the second position and back to the first position.

In another principal aspect of the present invention, in the last mentioned method, both of the person's legs are extended upwardly in the vertical in the first position with a resilient stretchable element attached to the foot of each leg to stretch and elongate each of the elements, and both extended legs are swung outwardly and away from the vertical to the second position and then back to the first position, whereby stretch is imparted to the inner thigh muscles when the legs are swung from the first position to the second position, and a resistance force is imparted to the inner thigh muscles by the resilient stretchable elements when the legs are swung from the second to the first position.

In another principal aspect of the present invention, in at least some of the foregoing exercises, one leg of the person exercising is extended in alignment with the body of the person and is relaxed, and a second resilient stretchable element is attached between the foot of the leg which is to be extended upwardly in the vertical and a hand of the person exercising to guide the leg when it is extended upwardly for swinging movement outwardly and away from the vertical to the second position and back to the first position, whereby when the upwardly extended leg is swung between the first and second positions and guided by the hand of the person exercising, the inner thigh is stretched and the hip joint is stretched of the extended leg, and when the leg is in the first position the hamstring muscle is stretched, while the neck and shoulder muscles of the person exercising are relaxed.

In still another principal aspect of the present invention, in at least some of the foregoing methods, the person is lying on the person's side with the extended leg having a pair of resilient stretchable elements attached thereto with the leg extending in substantial alignment with the remainder of the person's body in the first position, and the extended leg is swung backward at the knee from the first position to the second position and back to the first position, whereby the front and rear thigh muscles of the swinging extended leg are synergistically exercised.

In still another principal aspect of the present invention, in at least one of the foregoing exercises, the person exercising is sitting with the extended leg having the resilient element attached thereto extending substantially forward of the person when in the first position, and the extended leg is swung arcuately outwardly from the first position to the second position and back to the first position, whereby the outer and inner thigh muscles of the swinging extended leg are synergistically exercised.

In still another principal aspect of the present invention, a method of exercising the gluteal muscles of a person includes the person exercising assuming a kneeling position on one knee, stationarily fixing one end of a resilient stretchable element and attaching the opposite end thereof to the foot of the other leg which is not kneeling, extending the other leg to which the resilient stretchable element is attached to substantially full length to stretch and elongate the element, and arcuately swinging the foot of the extended leg toward and away from the foot of the kneeling leg.

In still another principal aspect of the present invention, in the last mentioned exercise, the resilient stretchable element is stationarily affixed either adjacent the knee of the kneeling leg or to the foot of the kneeling leg.

In still another principal aspect of the present invention, a method of imparting resistance exercises to the outer thigh muscles of the leg and the gluteal muscles of a person exercising includes the person exercising assuming a lying position on the person's side with one leg extended adjacent the surface upon which the person is lying, fixing one end of a resilient stretchable element at a location adjacent the surface upon which the person is lying, and attaching the opposite end of the resilient stretchable element to the foot of the other leg, extending the other leg to which the resilient stretchable element is attached to substantially full length and away from the first leg to stretch and elongate the element, and arcuately swinging the foot of the extended other leg toward and away from the foot of the first leg.

In still another principal aspect of the present invention, a method of exercising the gluteal muscles of the person exercising includes the person exercising assuming a lying position on the person's back, stationarily fixing the ends of an elongate stretchable element at a pair of spaced locations straddling the person's hips with the elongate stretchable element closely overlying the person's hips, and moving the hips upwardly against the elongate stretchable element.

In still another principal aspect of the present invention, a method of stretching the hip and groin muscles of a person exercising includes the person exercising assuming a sitting position with the knees bent and spaced outwardly from each other and the feet together, and stationarily fixing the ends of a resilient stretchable element below and forward and behind each knee and in closely overlying relationship to each leg adjacent the knee with the resilient flexible element exerting a downward resistance force on each leg adjacent the knee.

In still another principal aspect of the present invention, in the foregoing exercise methods, the resilient stretchable element is an extension spring which has a spring force which permits it to be stretched by the muscle force of a person so as to extend to a length which exceeds at least 100 percent of its length at rest, and when attached to the foot of the leg being exercised, it is attached by a flexible stretchable loop which grips the arch of the foot when a tension is drawn on the loop by the spring.

These and other objects, features and advantages of the present invention will be more clearly understood through a consideration of the following detailed description.

BRIEF DESCRIPTION OF THE DRAWINGS

In the course of this description, reference will frequently be made to the attached drawings in which:

FIG. 1 is a broken elevation view of one of the preferred embodiments of exerciser constructed in accordance with the principles of the present invention, and which is stationarily attached at one end and includes a preferred embodiment of flexible stretchable loop of the invention at the other end;

FIG. 2 is a cross-sectioned view of the loop, as viewed substantially along line 2—2 of FIG. 1;

FIG. 3 is a perspective view of a preferred form of platform which forms a part of one of the embodiments of exerciser of the present invention, and which shows an exerciser as shown in FIG. 1 in dot and dash attached in each of the anchor locations on the platform;

FIGS. 4A–4F depict various exercise routines utilizing the exerciser of the present invention together with the platform, and in which the person exercising is performing the routine in a lying position;

FIG. 4G is a broken perspective view of one of the anchor locations of the platform to which a different embodiment of exerciser is attached for use in the exercise routine depicted in FIG. 4F;

FIGS. 4H–4K depict exercise routines utilizing an exerciser of the present invention together with the platform, but in which the person exercising assumes a sitting position;

FIG. 4L depicts an exercise routine utilizing an exerciser of the present invention together with the platform, but in which the person exercising assumes a kneeling position;

FIG. 4M depicts an exercise routine utilizing an exerciser of the present invention together with the platform, but in which the person exercising assumes a standing position.

DESCRIPTION OF THE PREFERRED EMBODIMENTS

Figure 4A:
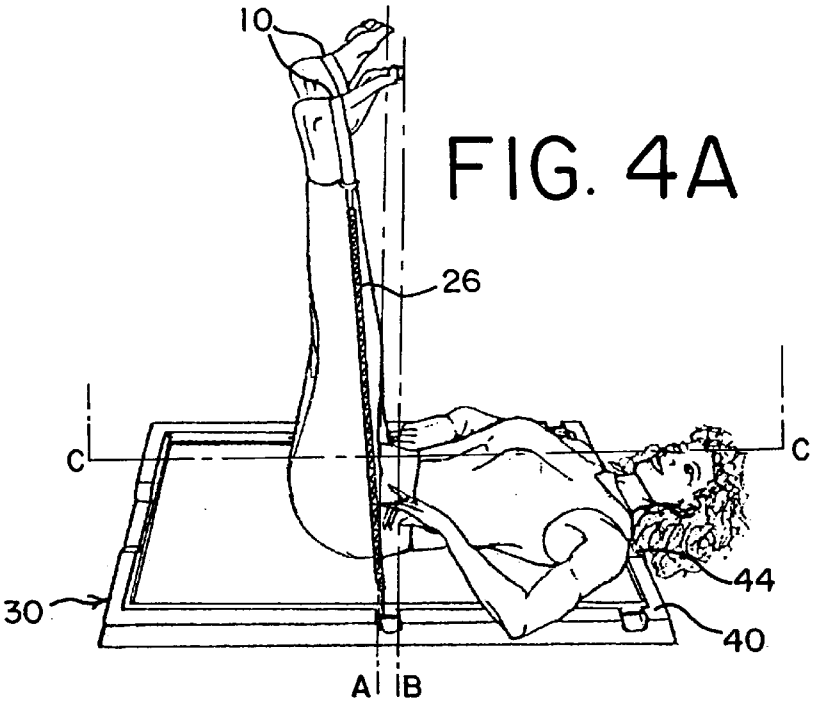

A preferred embodiment of exerciser constructed in accordance with the present invention is shown in FIGS. 1–3. The exerciser includes a flexible and stretchable loop 10 which comprises an elongate flexible elastic stretchable member 12, as seen in FIG. 2, which is formed of rubber or other stretchable elastomeric material. The member 12 is doubled back upon itself and folded to form the loop 10, as shown in FIG. 1. The elastic stretchable member 12 is preferably rectangular in cross-section as shown in FIG. 2, and is covered with a stretchable cloth textile material 14 which overlies both the flat surfaces of the rectangular member 12 as well as its edges and side surfaces, as seen in FIG. 2, so as to form a rounded contoured surface 16 at the edges of the loop. This rounding enhances the comfort to the user during an exercise routine and it, together with its rectangular shape, substantially enhances its grip on the hand or foot of the user. By way of example, it has been found that if the rectangular loop in cross-section as shown in FIG. 2 has a width of approximately one inch and a thickness of approximately ⅛–3/16 inch, it will comfortably grip the hand or foot of the user.

The textile material also functions to absorb any perspiration and to provide a secure gripping surface during and exercise routine. The textile material 14 has a weave which permits it to stretch and retract with the flexible elastic stretchable material 12. Such weave may for example be a braided weave which is capable of the desired stretch. A suitable material which may be employed to form the loop 10 and which consists of a stretchable elastomer which is covered with a stretchable textile material is the type of straping which is utilized for example with baseball umpire's chest protectors, although it will be understood that the present invention is not limited to such strapping material specifically.

The flexible elastic stretchable member 12 with its textile covering 14 is doubled back upon itself as shown in FIG. 1 and secured, such as by stitching 18, to form the loop 10. As so formed, the loop 10 preferably comprises a smaller loop portion 20 which receives a rectangular eye 22 of a releasable snap fastener 24 for attaching the loop 10 to a resilient stretchable element, for example, a coil extension spring 26, as shown in FIG. 1. The remaining larger portion 28 of the loop 10 is sized and configured to comfortably receive either the hand or the foot of the person exercising when the loop 10 is in its relaxed condition. By way of example, a suitable size of portion 28 results if the length of the stretchable member 12 with its covering 14 is about thirteen inches before doubling over and stitching and where the material which forms the portion 28 itself is about ten inches in length.

Although the snap fastener 24 connection to the spring 26 is preferred, it will be appreciated that other methods of fastening might be employed without departing from the principles of the invention. For example, the spring 26 may be fastened directly to the smaller loop portion 20. Although an extension spring is preferred, the resilient stretchable element 26 instead may be a length of stretchable elongated rubber or other elastomeric material. Moreover, the resilient stretchable element 26 and the flexible elastic stretchable loop material 12 may be molded integrally with each other in one piece construction, if desired, without departing from the principles of the invention.

What is important is that the resilient stretchable element or spring 26 has a spring force which permits it to be stretched by the muscle force of a person when the hand or the foot of the person is received in the loop so as to extend to a maximum length which exceeds at least 100% of its length at rest, and preferably 200–300% of its at rest length. Suitable at rest lengths may be about 12–30 inches. Such stretchability permits the exercisers of the invention to be used in performing a wide variety of exercise routines which exercisers heretofore have been incapable of performing, and as will be explained in further detail to follow, and to impart a desirable fluidity of motion which renders its use comfortable and eliminates jarring and undue strains on surrounding joints and muscles.

The loop 10 and its portion 28 is stretchable to the extent that in use in performing various exercise routines, it will stretch by a sufficient amount to grip the hand or foot of the person exercising, but not so much that it becomes uncomfortable or insecure, or that it nullifies the resistance provided by spring 26. In practice, it has been found that a stretch of about ⅛–¼ inch is satisfactory when exercising.

The exerciser as thus far described and as shown in FIG. 1 is capable of use in either of at least two general categories of use. In one general category of use the end of the spring 26 opposite the loop 10 of the invention is attached to a fixed anchor such as on a platform 30, as shown in FIGS. 1 and 3 and in the exercise routines as shown in FIGS. 4A–4E and 4H–4M. In the other general category of use, a second loop 10 of the invention is attached at the end of the spring 26 opposite the loop 10 and its fastener 24 as seen in FIG. 1. In this category of use exercise routines may be performed, such as shown for example in FIGS. 5A–5F.

The platform 30 preferably comprises a floor which is covered with a cushion or mat 32, as seen in FIG. 3. The mat 32 is preferably formed of a suitable foam or other material which is washable, and the mat is preferably removable from the platform 30 for that purpose. Whatever material the mat 32 is formed of, it should have good gripping qualities with the material of the platform floor to insure that it remains essentially flat and does not slip during the exercise routines.

The platform 30 is preferably formed of a molded plastic material with a pair of spaced parallel side rails 34 and 36 and a pair of shorter spaced parallel end rails 38 and 40. As molded, the underside of the side and end rails typically defines a cavity (not shown) with the outward faces of the rails forming downwardly facing linear edges 41, as shown in FIG. 3, which will frictionally engage the floor or carpet upon which the platform is positioned. This prevents the platform from moving during the exercise routines. The side rails 34 and 36 are spaced from each other by a distance sufficient to accommodate the body of the person exercising therebetween, as shown in the various exercise routines in FIG. 4, and sufficient to stabilize the platform during those routines. Likewise, the spacing of the end walls 38 and 40 should be sufficient for the platform to accommodate a substantial portion of the length of the body of the person performing the exercise routines.

Preferably the spacing of the side rails and end rails should be sufficient to perform the aforementioned functions, but should be the minimum necessary for these functions in order to minimize the size and weight of the platform to facilitate portability and storage. In view of this, the end rails 38 and 40 each preferably include an elongate notch 42 and 44, respectively, to comfortably accommodate either the neck or the legs of the person using the platform, such as for one of the exercise routines as shown in FIGS. 4A–4D. This permits one or more portions of the person's body to comfortably extend beyond the platform to minimize the size of the platform for transport and storage, but not impair its functionality in use. Indeed, the size of the platform may be minimized in this manner so that it may be easily transported as described in my copending patent application, Ser. No. 997,553, filed Dec. 28, 1992, the disclosure of which is incorporated herein by reference. Although not shown in the drawing, it will also be appreciated that the platform 30 may be hinged to permit folding when not in use to further reduce its size if desired to facilitate transport or storage.

It is also preferred that at least the end rails 38 and 40, and preferably also the side rails 34 and 36 be elevated from the top surface of the mat 32, as shown in FIG. 3, to provide a structure against which the person exercising may brace against during certain exercise routines, such as shown for example in FIGS. 4F and 4H–4J.

As best shown in FIG. 3, the side rails 34 and 36 each include a pair of anchor locations. One pair of anchor locations 46 and 48 are located in the side rails 34 and 36, respectively, adjacent one of the end rails 40. The other pair of anchor locations 50 and 52 are located in the side rails 34 and 36 intermediate the end rails 38 and 40, and preferably about midway between the end rails. It has been found that the positioning of these anchor locations as well as their number permits the use of the exerciser of the present invention, as shown in FIG. 1, with the platform 30 in over 150 different exercise routines.

The anchor locations may take any one of a number of different forms. In the preferred embodiment each of the anchor locations 46, 48, 50 and 52 preferably comprises a notch 54 in the side rails 34 and 36 with a rod 56 extending longitudinally in the notch, as shown in FIG. 3. Thus, the rod 56 provides an anchor for receiving a fastener, such as a releasable snap fastener 58 for attaching the end of the spring 26 opposite the loop 10 to the anchor rod 56, as shown in FIG. 1.

Although four exercisers are shown in dot and dash as attached to the platform in FIG. 3, this showing is for illustration purposes only to show all the locations at which the exercisers may be attached. In practice, in most of the exercise routines only two exercisers and in some only one will be attached to the platform 30, and either at the anchor locations on one of the side rails, at the anchor locations either nearest the end wall 40, or at the anchor locations intermediate the side rails 34 and 36. However, it is possible that in certain exercise routines all four anchors may be utilized. This might occur for example if two persons are utilizing the platform in an exercise, such as shown in FIG. 4M, in which two persons might both be standing on the platform in back to back relationship, or in an exercise such as shown in FIG. 4K.

From the foregoing it will be appreciated that a wide variety of exercise routines may be performed utilizing the exerciser of the present invention to exercise a large number of selected muscles or muscle groups without substantial involvement of other undesired muscle groups. A few such exercise routines utilizing the platform 30 will be described to follow, with particular reference to FIGS. 4A–4M. Indeed as previously mentioned, more than 150 exercise routines are possible utilizing the exerciser of the present invention together with the platform 30. A considerable number of these routines are not believed to have been previously possible and now make it possible to exercise muscles or muscle groups which either were not possible before, or if they were, they either required the assistance of a second person or imparted forces or strains to other muscle groups which were not desired to be exercised.

Figure 4B:
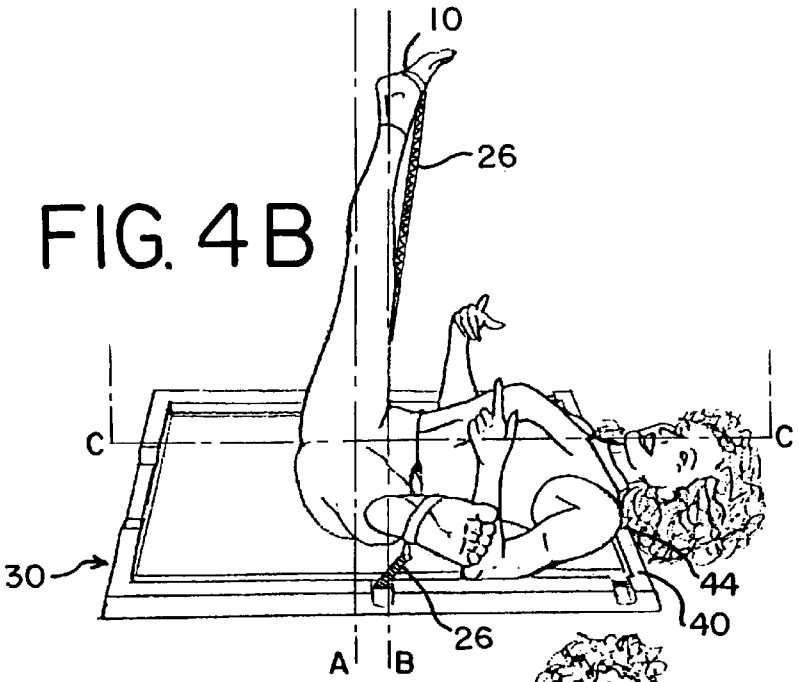

One such exercise routine which is believed to have not been previously possible before the present invention, is the aerial split routine shown in FIGS. 4A and 4B. In this routine the person exercising is shown lying upon her back with her neck comfortably accommodated by the notch 44 in end wall 40 so that her head can extend beyond the platform 30. Her hips are positioned in a plane A generally between the intermediate anchor locations on the platform which are in plane B as shown, and closely adjacent and parallel to plane A. The springs 26 are attached to the intermediate anchor locations in plane B, and her feet are received in the loops 10. In this routine the loops 10 are looped over and grip the arches of her feet when her legs are raised and extended upwardly and positioned together in the vertical position and generally in the plane C as shown in FIG. 4A. To perform this exercise routine, she will open her legs outward to the side and away from the plane C in a scissors movement to the position shown in FIG. 4B, return them to the vertical position as shown in FIG. 4A, and will repeat these movements. When moving her legs to the open position as shown in FIG. 4B, the inner thigh adductor muscles are stretched, and when closing her legs as shown in FIG. 4A, the springs 26 impart resistance to the inner thigh adductor muscles.

Figure 4C:
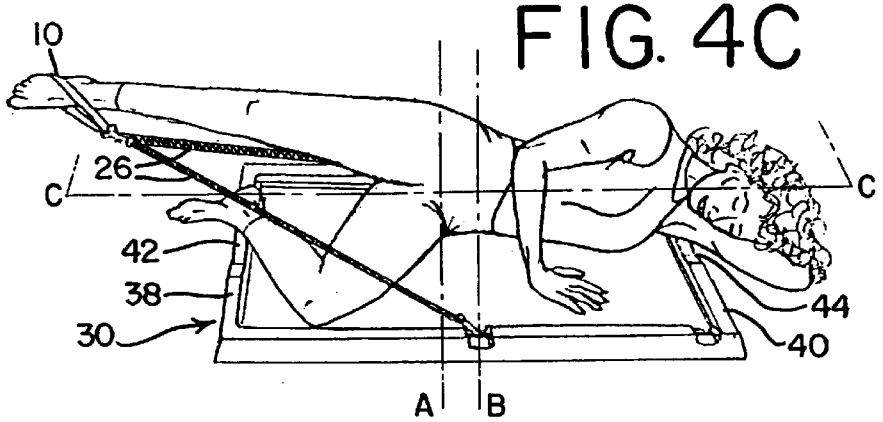
Figure 4D:
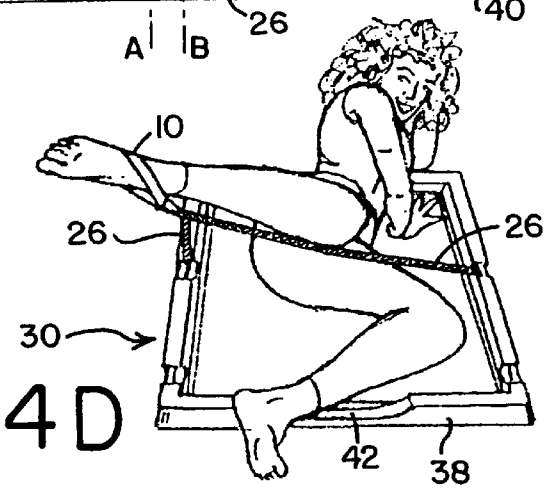
Figures 4J, 4K, 4L, 4M:
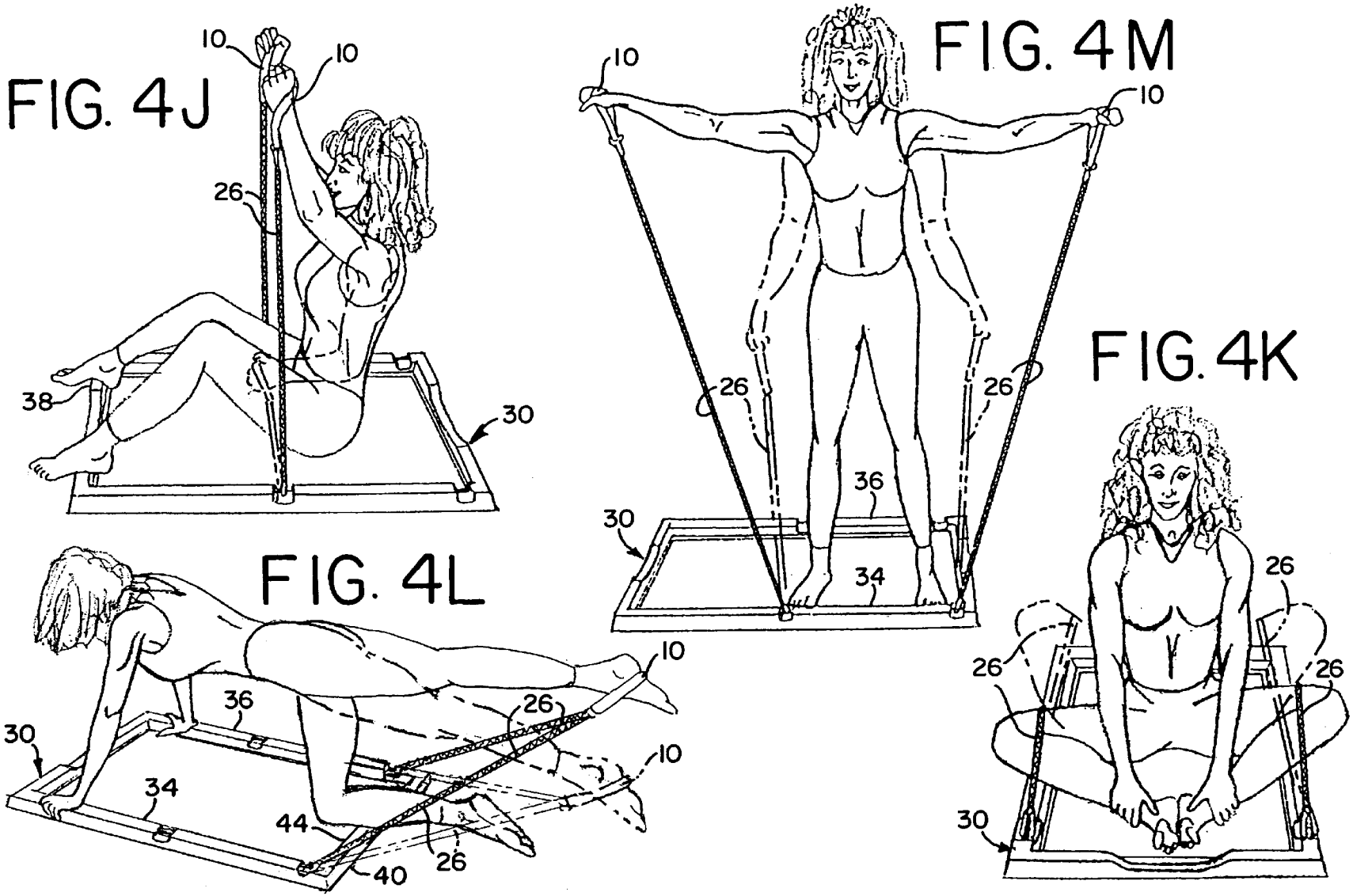

The exercise routine shown in FIGS. 4C and 4D results in a synergistic exercise primarily isolated to the thigh front muscles or quadriceps and the thigh rear muscles or hamstrings and which also is believed to have not been possible before with prior exercisers. In this exercise the person performing the routine lies on the platform 30 on her side with her hips generally positioned in plane A, her lower arm comfortably extending through and beyond the notch 44 on end rail 40 and her lower leg comfortably extending through and beyond the notch 42 on the end rail 38, as shown in FIG. 4C. Two springs 26 of the exerciser are both attached at one of their ends to the platform 30 intermediate anchor locations which are positioned in plane B, and which is closely adjacent and parallel to plane A. The other ends of the springs 26 are attached to one of the loops 10. The person performing the exercise extends her leg outwardly in line with her body and generally parallel to plane C to extend the spring 26 with the loop 10 extending over and gripping the arch of her foot. In this routine the person exercising then bends her knee to swing her leg from the extended position shown in FIG. 4C to the backward position shown in FIG. 4D away from plane C, then back again to the position shown in FIG. 4C, and repeats these movements. It will be seen that this exercise routine using the exerciser of the present invention together with the platform 30 exerts synergistic forces on both the quadriceps and hamstring muscles.

An example of a stretching exercise is shown in FIG. 4E which could be performed in the past only with assistance from a second person, or without assistance, with strain to the neck and shoulder muscles to provide upper body leverage. This exercise can be performed using the exerciser of the present invention, as shown in FIG. 4E both without such assistance and while the neck and shoulders are relaxed. In this routine the person exercising lies on her back with her hips positioned in plane A, her neck positioned in and beyond one of the notches of one end rail, and with her left leg extending comfortably through and beyond notch 42 in end rail 38. One spring 26 is attached at one end to one of the intermediate anchor locations in plane B which is closely adjacent and parallel to plane A, and at its other end to the loop 10. A second spring 26' is also attached to the loop 10, the latter of which grips the arch of her foot, and at the other end to a loop 10' which is held by her hand. In this exercise routine her upwardly extending leg may be either moved up and down in a plane C parallel to her other leg and back to stretch the hamstring muscles, or out to the side away from plane C and back up as shown in dot and dash in FIG. 4E to stretch the inner thigh adductor and hip joint. In either of these routines the person exercising is able to utilize the spring 26' and loop 10' to control and guide the leg being moved by her hand thus avoiding the need for assistance from a second person to maneuver the leg being stretched, and to avoid strain to the neck and shoulder muscles in the absence of assistance from a second person.

An exercise routine is shown in FIG. 4F in which the lower back and gluteal muscles are exercised. In this routine the person exercising again lies on her back with her neck comfortably received in and through the notch 44 on end rail 40, and her feet are braced against the opposite end rail 38. Instead of utilizing the loop 10 and highly stretchable spring 26 shown in FIG. 1, a somewhat modified exerciser is employed in this routine.

As shown in FIG. 4G, this exerciser comprises a pair of substantially stiffer springs 60 than the spring 26. One end of each of these springs is attached to the intermediate anchor locations, for example the location 50 as shown in FIG. 4G, and the other ends of the springs are attached by a belt 62 which may or may not be stretchable. The belt 62 preferably includes some form of mechanism for adjusting its length, such as a buckle 64.

In this routine the belt 62 is placed over the hips of the person exercising, and the person performs the routine by moving her hips up and down in a bridging movement, as shown in FIG. 4F against the resistance of the exerciser. As previously mentioned, this exercise with the resistance produced by the exerciser in the upward movement of the hips is particularly beneficial in exercising the gluteal muscles and lower back. It was not believed to be previously possible to perform this exercise with resistance, without the assistance of a second person, or in the absence of such assistance, without weights on the abdomen which are uncomfortable and impair breathing.

In FIG. 4H a sitting exercise routine is depicted which, like the routine in FIGS. 4C and 4D, is a synergistic exercise in this case of the outer thigh abductor and inner thigh adductor muscles. In this routine the person exercising sits on the platform 30 and braces one foot against end rail 38 with her hips positioned generally in plane A. The exerciser springs 26 of the invention are attached at their ends to the anchor locations intermediate the length of the platform which are in plane B and which is closely adjacent to and parallel to plane A. The other ends of the springs 26 are attached to a loop 10 which, in turn, is attached about her foot and arch, and which grips her arch when her leg is extended as shown in solid in FIG. 4H. If she moves her right leg from the position shown in solid in FIG. 4H so as to swing it outward and away from plane C to the position shown in dot and dash, and then in toward the plane C to the second position shown in dot and dash, her outer and inner thigh muscles are synergistically exercised. Again, such synergistic exercise was not believed to be previously possible using other prior exercisers.

In at least some of the previously described exercise routines, for example those shown in FIGS. 4A–4E and 4F, the hip plane A is shown and described as being closely adjacent to the intermediate anchor plane B. However, if the person performing the exercise wishes to increase the resistance of the spring or springs 26, all she need do is to position her hips so that the spacing between planes A and B is greater. With reference to FIGS. 4C and 4D by way of example, all she need do is move her hips and, therefore, plane A closer to the end rail 38 and further from plane B to increase the resistance.

In FIG. 4I an exercise routine is shown which exercises the stomach muscles in a "reverse stomach crunch" exercise. In this routine two springs 26 are again used which this time are attached at one of their ends to the anchor locations adjacent the end wall 40. The person exercising sits on the platform as shown and braces her feet against the end wall 40. She then grasps the loop 10 which is attached to the other end of both of the springs 26 and moves her back up and down exercising the stomach muscles, as shown in solid and dot and dash in FIG. 4I. Again it is believed that this exercise could not previously be performed with the prior exercisers without imparting strain to the neck and lower back muscles which is prevented in this exercise by the support provided by the springs 26. The exercise of the invention permits this exercise to be performed without such strain.

Another sitting exercise routine is shown in FIG. 4J. This exercise routine develops the arm and chest muscles. In this exercise routine the person exercising sits in the middle of the platform 30 with her feet braced against one of the end rails 38. The exerciser springs 26 are attached at one end to the intermediate anchor locations on the platform 30, and the loops 10 are grasped by the hands of the person exercising. The arms are then moved up and down, as shown in solid and dot and dash in FIG. 4J.

In FIG. 4K another sitting exercise routine is shown. This exercise routine stretches the hip, groin and inner thigh muscles which was not believed to have been previously possible before without the assistance of a second person to push the legs down, and to avoid strain to the upper back in the absence of assistance from a second person. In this exercise the loop 10 of the exerciser shown in FIG. 1 is not employed. The person performing the exercise sits as shown in FIG. 4K and the springs 26 are laid over her legs adjacent her opened out knees, and are each attached at each of their ends to the end anchor locations and the intermediate anchor locations, respectively, below and forward and to the rear of her knees. If the person exercising does nothing further, the hip, groin and thigh muscles are stretched. If the person exercising moves her knees from the position shown in solid upwardly to that shown in dot and dash in FIG. 4K, resistance forces are also imparted to the inner thigh muscles.

It will be appreciated in the various platform exercise routines thus far described in which the exerciser of the invention is attached to the anchor locations intermediate the length of the platform, that the person performing the exercise may face with equal facility in the direction opposite to that shown in the drawings while performing the routine.

In FIG. 4L an exercise routine is shown in which resistance forces are transmitted to the gluteal muscle in a manner which is not believed to have been possible with previous exercisers. In this routine the person performing the exercise kneels on one knee on the platform 30 as shown and braces her hands on the side rails 34 and 36 with the shin of her kneeling leg extending through and beyond the notch 44 in the end rail 40. One end of each of the springs 26 is attached at each of the end anchor locations and adjacent her kneeling knee, and the other ends of the two springs are attached to a loop 10 which, in turn, receives and grips the arch of the foot of the person exercising when her other leg is extended to stretch and elongate the springs 26. In this routine, the person's left extended leg is moved back and forth between the positions shown in dot and dash and solid in FIG. 4L, thus transmitting resistance forces directly through the exercising leg to the gluteal muscle group. In the alternative, this exercise may also be performed using only one spring 26.

In FIG. 4M, the last of the routines shown in the drawings which utilize the platform 30, one end of each of the springs 26 of the exerciser is attached to the intermediate and end anchor locations on one of the side rails 34, and the loops 10 at the other end of the springs 26 are grasped by the hands of the person exercising. In this exercise the arms are moved between the positions shown in solid and dot and dash to stretch and extend the springs 26 to exercise the arm muscles. It will be appreciated that this exercise may be performed with equal facility also by attaching the springs 26 to either both end anchor locations, both intermediate anchor locations or both anchor locations on the opposite side rail 36. If desired, two springs may be attached to each other in series if it is desired to decrease the spring force.

It will be appreciated that this last described exercise as well as other exercises may be performed simultaneously by two people using the same platform 30. For example in the exercise shown in FIG. 4M another person may stand on the platform 30 in back to back relationship to the person shown. In many of the previously described routines, a second person may also exercise using the platform, but positioned off of the platform so long as one person is on the platform to maintain it in place.

FIGS. 5A–5F are shown as exemplary of several exercises of the category of use in which one end of the spring is stationarily fixed such as to the platform 30, but instead utilizes two loops 10 and 10' of the invention, one at each end of the spring 26 of the exerciser.

Figure 5A:
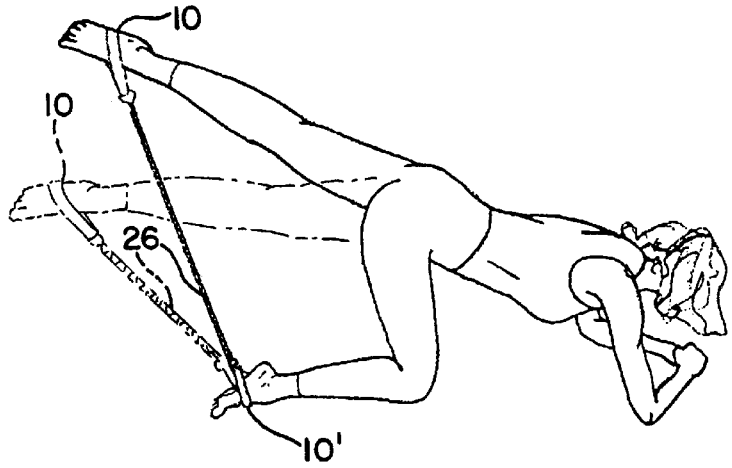
FIGS. 5A–5F depict several exercise routines in the kneeling, lying or standing positions which do not utilize the platform, but instead utilize a pair of flexible stretchable loops in accordance with the invention.

In the routine shown in FIG. 5A the person exercising kneels on one knee with one of the loops 10' about and gripping the arch of one foot. The other loop 10 is then placed about and grips the arch of the other foot, when the person exercising extends her left leg and moves it between the positions shown in solid and dot and dash in FIG. 5A. This exercise routine again results in maximum resistance forces being exerted to the gluteal muscle group through the raised extended leg. In this exercise it will be seen that the fulcrum about which the leg moves is at the gluteal muscle group. By imparting the spring resistance to the arch of the foot of the extended leg, rather than the ankle, knee or thigh thereof, the exercising lever arm is maximized, and the resistance forces bypass the weaker ankle and knee and are imparted directly to the desired gluteal muscles.

Figure 5B:
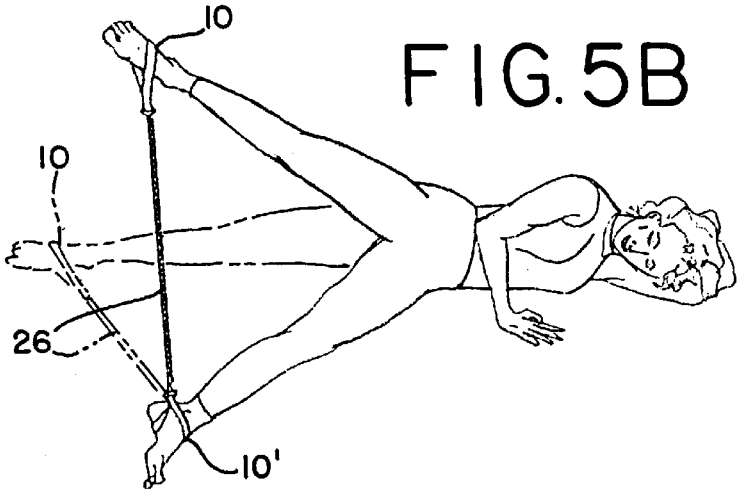

In FIG. 5B an exercise routine is shown in which the person exercising lies upon her side with her left leg extending forward of her body, her right leg extending upwardly, and the loops 10 and 10' are positioned about and grip the arches of each of her feet. To perform this routine she moves her right upwardly extended leg up and down between the positions shown in solid and dot and dash. This routine imparts resistance exercise to the outer thigh abductor and gluteal muscles of the leg being exercised.

Figure 5C:
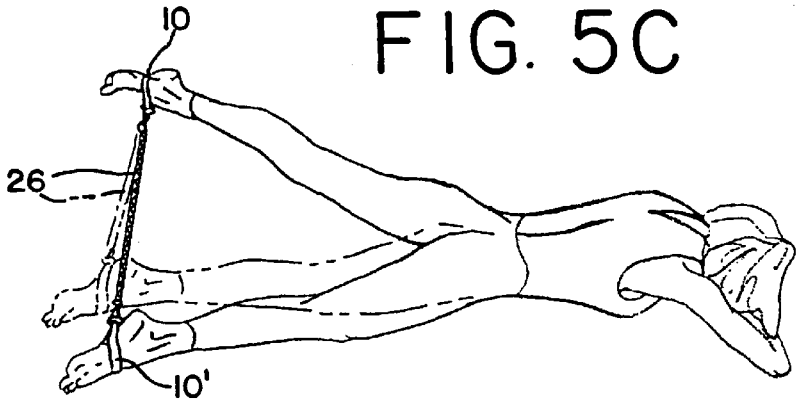

In FIG. 5C an exercise routine is depicted in which the person exercising lies upon her stomach, the loops 10 and 10' grip the arches of each of her feet, and the person exercising moves one of her legs, in this case her left leg, in and out in a scissors-like fashion, as shown in solid and dot and dash in FIG. 5C. Again, this routine imparts resistance forces to the gluteal muscles. In the alternative both legs can be moved in and out in unison in a scissors-like fashion.

Figure 5D:
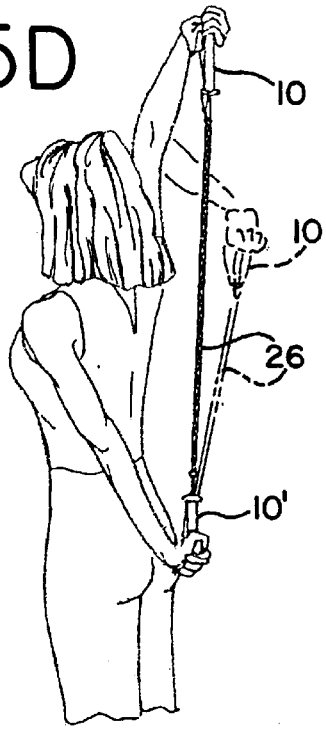

In FIG. 5D an exercise routine is shown for exercising the tricep muscles. In this routine the loops 10 and 10' at each end of the exerciser are grasped by and grip the hands with the spring 26 in back of the person, and the right arm is moved between the positions shown in solid and dot and dash.

Figure 5E:
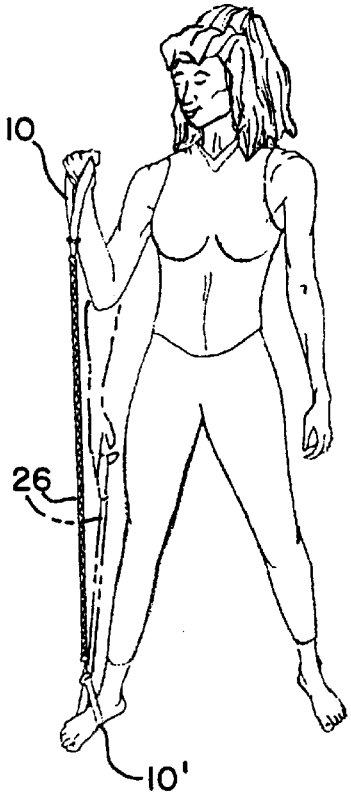

In FIG. 5E an exercise routine is shown for development of the bicep muscles. In this routine one loop 10' is placed about the arch of the person's foot and the other loop 10 is grasped by the hand. The arm to be exercised is then moved between the solid and dot and dash positions, as shown in FIG. 5E.

Figure 5F:
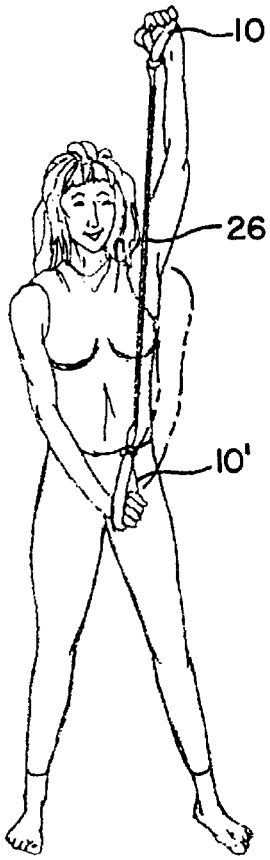

In FIG. 5F an exercise routine is shown for developing the deltoid and pectoralis muscles. In this routine the exerciser loops 10 and 10' are grasped in the hands as shown, and the left arm is moved between the positions shown in solid and dot and dash.

It will be appreciated that in all of the routines shown in FIG. 5 in which the exercise is performed by one arm or leg, that the same exercises may be performed with the other arm or leg. Moreover, each of the exercise routines shown in FIGS. 5A–5D and 5F, the arm or leg being moved during the exercise imparts exercise work to the muscle group described. However, the stationary limb or its gluteal muscle will also experience isometric exercise.

It has been discovered that when utilizing the exerciser of the present invention without the platform 30 and with two loops one at each end of the spring 26, at least 40 exercise routines may be followed for the exercise of the thigh and gluteal muscles, and at least 30 more routines may be followed for the exercise of the arm muscles.

If it is desired to increase the work imparted to any particular muscle or muscle group by the exerciser of the invention, one or more additional springs 26 may be added to any single spring as depicted in either FIGS. 4 or 5.

The large number of different exercise routines which may be performed with the exerciser, either with or without the platform, is made possible at least in part by the selected spring force of the spring 26. This force is selected to be such that when the hand or foot of a person is received in and gripped by the loop and the spring is stretched by the muscle force of the person to its maximum length, it is capable of exceeding at least 100% of its length at rest, and preferably 200–300% of its length at rest. This permits the same spring to be utilized in the wide variety of routines either with or without the platform 30. Although in any given exercise routine the spring may not and usually does not extend to its maximum length, the ability to stretch to this maximum length imparts a desirable fluidity of motion in the range in which it is operated in a given routine which renders its use comfortable and eliminates jarring and undue stains on surrounding joints and muscles. Tighter springs with heavier spring forces and lesser degrees of elongation increase discomfort in use, produce jarring to surrounding joints and muscles, and substantially reduce the number of exercise routines that may be performed because of their inability to readily stretch sufficiently so as to permit for example a full leg stretch such as shown in FIG. 4L.

It will also be appreciated that the unique elastic stretchable loop 10 of the present invention results in a number of advantages which did not exist in prior exercisers. Because the loop 10 itself is stretchable, it receives, closely conforms to and grips either the hand of the user and importantly the arch of the foot when any spring force is exerted on it by a spring 26. Thus, both comfort and safety in use are improved because the loop is less likely to slip from the hand or foot. This stretchability also permits the loop to grip the arch of the foot so that the resistance forces imparted to the foot are imparted to one of the structurally strongest parts of the body, rather than to the ankle or knee of the person exercising as in many prior exercises. The ankle or knee is one of the structurally weakest parts of the body. Moreover, the textile covering 14 on the loop further improves the gripping action of the loop and also makes it more comfortable to the person exercising. In addition, the textile covering 14 absorbs perspiration to further improve the grip and reduce the likelihood that the loop will slip during use.

It will be understood that the preferred embodiments of the present invention which have been described are merely illustrative of the principles of the present invention. Numerous modifications may be made by those skilled in the art without departing from the true spirit and scope of the invention.

I claim:

1. A method of exercising the leg thigh muscles of a person, comprising:

the person exercising assuming a position lying on the person's back:

stationarily fixing an end of a resilient stretchable element to a point which is in a plane which is substantially parallel to a plane which passes through the hips of the person exercising;

attaching the opposite end of the resilient stretchable element to the foot of the leg to be exercised;

extending the leg to which the resilient stretchable element is attached to substantially full length to stretch and elongate the element;

swinging the extended leg and the extended element from a first position in which the leg extends upwardly in the vertical and is closely adjacent a plane bisecting the head and hips of the person exercising to a second position outwardly and away from the vertical and the last mentioned plane, and back to said first position; and wherein said resilient stretchable element is an extension spring which has a spring force which permits it to be stretched by the muscle force of the person so as to extend to a length which exceeds at least 100% of its length at rest.

2. The method of claim 1, wherein both of the person's legs are extended upwardly in the vertical in said first position with a resilient stretchable element attached to the foot of each leg to stretch and elongate each of the elements, and both extended legs are swung outwardly and away from the vertical to said second position, and then back to said first position, whereby stretch is imparted to the inner thigh muscles when the legs are swung from the first position to the second position, and a resistance force is imparted to the inner thigh muscles by said resilient stretchable elements when the legs are swung from the second to the first position.

3. The method of claim 2, wherein said resilient stretchable element is attached to the foot of the leg to be exercised by a flexible stretchable loop which grips the arch of the foot when a tension is drawn on the loop by the resilient stretchable element.

4. A method of exercising the leg thigh muscles of a person, comprising:

the person exercising assuming a position lying on the person's back;

stationarily fixing an end of a resilient stretchable element to a point which is in a plane which is substantially parallel to a plane which passes through the hips of the person exercising;

attaching the opposite end of the resilient stretchable element to the foot of the leg to be exercised;

extending the leg to which the resilient stretchable element is attached to substantially full length to stretch and elongate the element;

swinging the extended leg and the extended element from a first position in which the leg extends upwardly in the vertical and is closely adjacent a plane bisecting the head and hips of the person exercising to a second position outwardly and away from the vertical and the last mentioned plane, and back to said first position; and wherein the other leg of the person exercising is extended in alignment with the body of the person and is relaxed, attaching a second resilient stretchable element between the foot of the leg which is to be extended upwardly in the vertical and a hand of the person exercising to guide the leg when it is extended upwardly for swinging movement outwardly and away from the vertical to said second position and back to said first position, whereby when the upwardly extended leg is swung between said first and second positions and guided by the hand of the person exercising, the inner thigh is stretched and the hip joint is stretched of the extended leg and when the leg is in said first position the hamstring muscle is stretched, while the neck and shoulder muscles of the person exercising are relaxed.

5. The method of claim 4, wherein said resilient stretchable element is an extension spring which has a spring force which permits it to be stretched by the muscle force of the person so as to extend to a length which exceeds at least 100% of its length at rest.

6. The method of claim 4, wherein said resilient stretchable element is attached to the foot of the leg to be exercised by a flexible stretchable loop which grips the arch of the foot when a tension is drawn on the loop by the resilient stretchable element.

7. A method of exercising the leg thigh muscles of a person, comprising:

stationarily fixing an end of a resilient stretchable element to a point which is in a plane which is substantially parallel to a plane which passes through the hips of the person exercising;

attaching the opposite end of the resilient stretchable element to the foot of the leg to be exercised;

extending the leg to which the resilient stretchable element is attached to substantially full length to stretch and elongate the element;

swinging the extended leg and the extended element from a first position in which the leg is closely adjacent a plane bisecting the head and hips of the person exercising to a second position outwardly and away from the last mentioned plane; and wherein the person exercising is lying on the person's side with the extended leg having a pair of resilient stretchable elements attached thereto with the leg extending in substantial alignment with the remainder of the person's body in said first position, and said extended leg is swung backward at the knee from said first position to said second position while bending the knee and back to said first position, whereby the front and rear thigh muscles of the swinging extended leg are synergistically exercised.

8. The method of claim 7, wherein said resilient stretchable element is an extension spring which has a spring force which permits it to be stretched by the muscle force of the person so as to extend to a length which exceeds at least 100% of its length at rest.

9. The method of claim 8, wherein said spring is attached to the foot of the leg to be exercised by a flexible stretchable loop which grips the arch of the foot when a tension is drawn on the loop by the spring.

10. The method of claim 7, wherein said resilient stretchable element is attached to the foot of the leg to be exercised by a flexible stretchable loop which grips the arch of the foot when a tension is drawn on the loop by the resilient stretchable element.

11. A method of exercising the leg thigh muscles of a person, comprising:

stationarily fixing an end of a resilient stretchable element;

attaching the opposite end of the resilient stretchable element to the foot of the leg to be exercised;

moving the leg to which the resilient stretchable element is attached to stretch and elongate the element;

moving the leg to which the elongated and stretched resilient element is attached from a first position in which the leg is closely adjacent a plane bisecting the head and hips of the person exercising to a second position outwardly and away from the last mentioned plane; and wherein the person exercising is sitting with the leg to be exercised having the resilient element attached thereto extending substantially forward of the person when in said first position, and said leg to be exercised is swung from said first position to said second position, and back to said first position.

12. The method of claim 11, wherein said resilient stretchable element is an extension spring which has a spring force which permits it to be stretched by the muscle force of the person so as to extend to a length which exceeds at least 100% of its length at rest.

13. The method of claim 12, wherein said spring is attached to the foot of the leg to be exercised by a flexible stretchable loop which grips the arch of the foot when a tension is drawn on the loop by the spring.

14. The method of claims 11, wherein said resilient stretchable element is attached to the foot of the leg to be exercised by a flexible stretchable loop which grips the arch of the foot when a tension is drawn on the loop by the resilient stretchable element.

15. A method of imparting resistance exercises to the outer thigh muscles of a leg and the gluteal muscles of a person exercising, comprising:

the person exercising assuming a lying position on the person's side with one leg extended adjacent the surface upon which the person is lying;

fixing one end of a resilient stretchable element at a location adjacent the surface upon which the person is lying;

attaching the opposite end of the resilient stretchable element to the foot of the other leg;

moving the other leg to which the resilient stretchable element is attached away from said one leg to stretch and elongate the element; and moving the foot of the other leg toward and away from the foot of said one leg.

16. The method of claim 15, wherein said one leg is moved forward of the person exercising, and said one end of said resilient flexible element is stationarily fixed to the foot of said one leg.

17. The method of claim 16, wherein said resilient stretchable element is an extension spring which has a spring force which permits it to be stretched by the muscle force of the person so as to extend to a length which exceeds at least 100% of its length at rest.

18. The method of claim 17, wherein said spring is attached to each foot by a flexible stretchable loop which grips the arches of the feet when a tension is drawn on the loops by the spring.

19. The method of claim 16, wherein said resilient stretchable element is attached to each foot by a flexible stretchable loop which grips the arches of the feet when a tension is drawn on the loops by the resilient stretchable element.

20. The method of claim 15, wherein said other leg to which the resilient stretchable element is attached is extended to substantially full length and away from said one leg to stretch and elongate the element; and arcuately swinging the foot of the other leg toward and away from the foot of said one leg.

21. The method of claim 11, including stationarily fixing an end of a resilient stretchable element to a point which is in a plane which is substantially parallel to a plane which passes through the hips of the person exercising;

extending the leg to which the resilient stretchable element is attached to substantially full length to stretch and elongate the element;

swinging the extended leg and the extended element from a first position in which the leg is closely adjacent a plane bisecting the head and hips of the person exercising to a second position outwardly and away from the last mentioned plane; and wherein the person exercising is sitting with the extended leg having the resilient element attached thereto extending substantially forward of the person when in said first position, and said extended leg is swung arcuately outwardly from said first position to said second position, and back to said first position, whereby the outer and inner thigh muscles of the swinging extended leg are synergistically exercised.

22. A method of exercising the lower back and gluteal muscles of a person exercising, comprising:

the person exercising assuming a lying position on the person's back;

stationarily fixing the ends of an elongate stretchable element at a pair of spaced locations straddling the person's hips with the elongate stretchable element closely overlying the person's hips; and simultaneously moving the hips upwardly against the elongate stretchable element.

23. A method of stretching the hip and groin muscles of a person exercising, comprising:

the person exercising assuming a sitting position with the knees bent and spaced outwardly from each other and the feet together; and stationarily fixing the ends of a resilient stretchable element below and forward and behind each knee, and closely overlying each leg adjacent the knee with said resilient flexible element exerting a downward resistance force on each leg adjacent the knee.

24. The method of claim 23, including moving the knees upwardly against said downward resistance force to impart a resistance force to the inner thigh muscles.

25. The method of claim 5, wherein said spring is attached to the foot of the leg to be exercised by a flexible stretchable loop which grips the arch of the foot when a tension is drawn on the loop by the spring.

26. A method of exercising the gluteal muscles of a person, comprising the person exercising assuming a kneeling position on one knee;

stationarily fixing an end of a resilient stretchable element adjacent the knee of the kneeling leg;

attaching the opposite end of the resilient stretchable element to the foot of the other leg which is not kneeling;

moving the foot of said other leg to which the resilient stretchable element is attached away from the knee of the kneeling leg to stretch and elongate the element; and moving the foot of the other leg toward and away from the foot of the kneeling leg.

27. A method of exercising the gluteal muscles of a person, comprising the person exercising assuming a kneeling position on one knee, stationarily fixing an end of a resilient stretchable element to the foot of the kneeling leg, attaching the opposite end of the resilient stretchable element to the foot of the other leg which is not kneeling;

moving the foot of said other leg to which the resilient stretchable element is attached away from the knee of the kneeling leg to stretch and elongate the element; and moving the foot of the other leg toward and away from the foot of the kneeling leg.

28. A method of exercising the gluteal muscles of a person, comprising the person exercising assuming a kneeling position on one knee, stationarily fixing an end of a resilient stretchable element;

attaching the opposite end of the resilient stretchable element to the foot of the other leg which is not kneeling;

moving the foot of said other leg to which the resilient stretchable element is attached away from the knee of the kneeling leg to stretch and elongate the element;

moving the foot of the other leg toward and away from the foot of the kneeling leg; and where in said other leg is extended to substantially full length to stretch and elongate the element, and the foot of the extended leg is arcuately swung toward and away from the foot of the kneeling leg.

* * * * *